US005524463A

United States Patent [19]

Schenkel et al.

[11] Patent Number: 5,524,463

[45] Date of Patent: Jun. 11, 1996

[54] THEFT DETERRENT DEVICE TO FACILITATE EASY PROTECTION OF LARGE IRREGULARLY-SHAPED GOODS

[75] Inventors: Howard M. Schenkel; Luis E. Anderson, both of Boca Raton; Hans P. Witzky, Pompano Beach, all of Fla.

[73] Assignee: Sensormatic Electronics Corporation, Deerfield Beach, Fla.

[21] Appl. No.: 180,024

[22] Filed: Jan. 11, 1994

[51] Int. Cl.[6] ..... E05B 65/00

[52] U.S. Cl. ..... 70/57.1; 24/16 PB; 340/572; 292/307 R

[58] Field of Search ..... 70/57.1; 292/307 R–311, 292/315–322, 325; 340/572; 24/30.5, 16 PB

[56] References Cited

U.S. PATENT DOCUMENTS

| | | | |
|---|---|---|---|
| 3,206,814 | 9/1965 | Schumm | 292/325 X |
| 3,352,040 | 11/1967 | Javkin | 40/21 |
| 3,858,280 | 1/1975 | Martens | 24/150 |
| 4,196,424 | 4/1980 | Williamson | 340/572 |
| 4,580,319 | 4/1986 | Paradis | 292/317 X |
| 4,590,461 | 5/1986 | Cooper | 70/57.1 X |
| 4,825,156 | 4/1989 | Read | 292/318 X |
| 4,883,295 | 11/1989 | Kesselman | 292/307 R |
| 4,940,268 | 7/1990 | Lesquir et al. | 292/317 |
| 4,958,414 | 9/1990 | Benoit | 24/16 PB |
| 5,079,540 | 1/1992 | Narlow et al. | 340/572 |
| 5,293,669 | 3/1994 | Sampson | 24/16 PB |
| 5,367,289 | 11/1994 | Baro et al. | 70/57.1 X |
| 5,377,388 | 1/1995 | DeBever | 292/319 X |
| 5,377,510 | 1/1995 | Smith | 24/16 PB |

FOREIGN PATENT DOCUMENTS

| | | | |
|---|---|---|---|
| 21849 | 1/1981 | European Pat. Off. | 70/57.1 |

*Primary Examiner*—Steven N. Meyers
*Assistant Examiner*—Suzanne L. Dino
*Attorney, Agent, or Firm*—Robin, Blecker, Daley & Driscoll

[57] ABSTRACT

An attachment assembly for attaching a theft-deterrent tag to an article to be protected in an article surveillance system, the assembly comprising a strap having a first end and a strap section extending from the first end, the strap section being adapted to loop around so as selectively bring subsections of the strap section adjacent the first end and having a plurality of first engagement means spaced along the length of the strap section. The first end includes a second engagement means adapted to engage with the first engagement means included in a subsection of the strap section brought adjacent to the first end when the strap section is looped around, thereby to form a closed loop of a selective dimension. The first end and strap section are further adapted to include means for receiving a locking means for locking the strap section and first end together.

19 Claims, 2 Drawing Sheets

THEFT DETERRENT DEVICE TO FACILITATE EASY PROTECTION OF LARGE IRREGULARLY-SHAPED GOODS

BACKGROUND OF THE INVENTION

This invention relates to theft deterrent tags, and, in particular to a theft deterrent tag and attachment assembly for facilitating Electronic Article Surveillance ("EAS") protection of large irregular-shaped articles.

Theft detection tags for articles and goods have found widespread application, particularly, in the retail environment. Due to the wide variety of different sizes and shapes of the articles with which these tags are used, many different ways of attaching or adhering such tags to the articles have been developed.

For example, in one type of theft detection tag, the tag is directly attached to an article by utilizing clamp-like or pin-like attachment assemblies. Such assemblies require clamping onto the article or piercing through the article which, in some cases, may not be realizable due to the irregular shape or hardness of the article.

One type of tag specifically adapted to be attached to irregular-shaped articles is the tag disclosed is U.S. Pat. No. 5,079,540 to Narlow et al. ("Narlow, et al."). In the tag of the Narlow, et al. patent, an attachment assembly is used comprising a flexible tie wrap having a first end which is fixed to the body of the tag and a second end which is free. The body of the tag also includes a channel which can receive the end of the tie wrap to form a loop. The second end of the tie wrap engages and is locked in the channel by a biased spring arm arranged in the tag body and entering the channel. The spring arm is released by the magnetic attraction of a magnet disposed on the spring arm.

The aforesaid use of a spring arm in the attachment assembly of the Narlow, et al. tag complicates the attachment assembly and makes it costly. Accordingly, other types of attachment assemblies of less complication and cost are being sought.

It is, therefore, an object of the present invention to provide a theft deterrent tag and attachment assembly which can be used with irregular shaped articles.

It is a further object of the present invention to provide a theft deterrent tag and attachment assembly which are of simpler construction.

It is yet a further object of the present invention to provide a theft deterrent tag and attachment assembly which is adapted to permit conventional tags having pin-like assemblies to be also attachable to irregular-shaped articles.

SUMMARY OF THE INVENTION

In accordance with the principles of the present invention, the above and other objectives are realized in a theft-deterrent tag and attachment assembly in which the attachment assembly comprises a strap having a first end and a strap section extending from the first end. The strap section is adapted to loop around so as to bring subsections of the strap section adjacent to the first end. First engagement means is included in each subsection to engage with second engagement means at the first end so that a closed loop of preselected dimension can be formed. The first end and the subsections of the strap section are each adapted to receive a locking means for locking the first end and a sub-section together when in adjacent engaging relationship to form a closed loop.

In the form of the invention to be disclosed hereinafter, the first end and the subsections are provided with apertures which align when the first engagement means of a subsection is in engagement with the second engagement means of the first end. In this case, a locking means is used which includes a pin-like locking assembly having a pin which extends through said apertures and whose head end has a cap for engaging the first end, whose shaft has parts which engage the walls of the apertures and whose tail end is clamped to prevent withdrawal of the pin from the strap. Also, in this case, the clamp is housed within a tag body which abuts the first end and in which is disposed a device or element which permits detection of the tag. The tag body and pin-like assembly can be those of a conventional theft deterrent tag used for soft articles.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
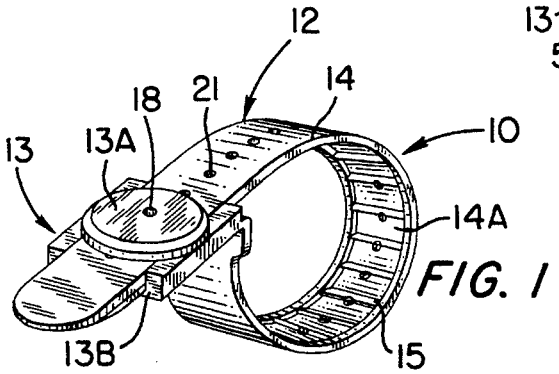
FIG. 1 shows an angled view of an attachment assembly for a theft-deterrent tag in accordance with the principles of the present invention.
Figure 2:
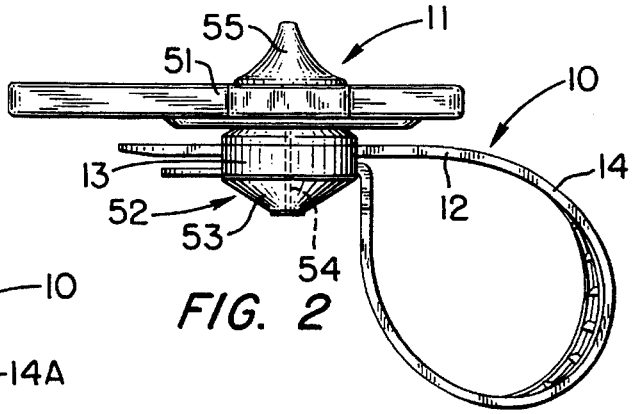
FIG. 2 shows a side view of the attachment assembly of FIG. 1 with a theft-deterrent tag attached thereto.
Figure 3:
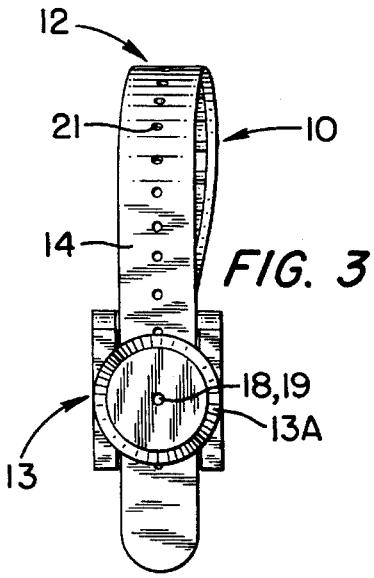
FIG. 3 shows a top and bottom views of the theft-deterrent tag of FIG. 1.
Figure 4:
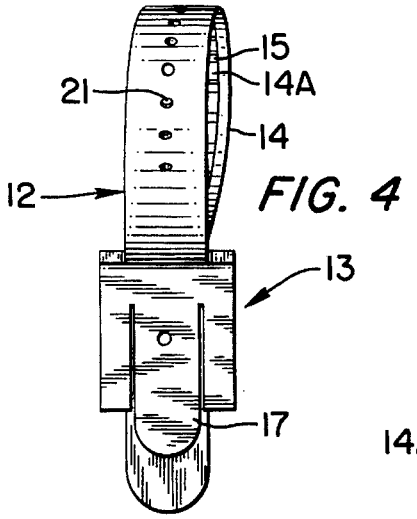
FIG. 4 shows a bottom view of the theft-deterrent tag of FIG. 1.

FIGS. 1–6 show an attachment assembly 10 for a theft-deterrent tag 11 in accordance with the principles of the present invention. As shown, the assembly 10 comprises a strap 12 which, in the case illustrated, is a one-piece molded member. The strap 12 includes a first end 13 and a bendable thin strap section 14.

The first end 13 of the strap 10 is formed as a low-profile channel member having upper and lower walls 13A and 13B. The strap section 14 extends from the upper wall 13B of the first end 13 and can be looped around to selectively bring subsections 14A of the strap section between the upper wall 13A and lower wall 13B and, thus, within the channel defined by the first end. A closed loop of a selective dimension can thus be formed permitting attachment of the assembly 10 to irregularly-shaped articles of various dimensions.

In the present illustrative case, the attachment assembly 10 is adapted to carry a theft deterrent tag 11 (see, FIG. 2) on its first end 13 and, as will be explained below, the tag 11 acts to lock the first end to the strap section. As shown, the tag 11 includes a tag body 51 and a pin-like assembly 52. The assembly 52 includes a cap 53 and a pin 54 which extends from the cap and is received and held by a clamp, clutch or grip assembly 55 disposed in the tag body 51. The tag 11 can be a conventional tag as used for soft goods.

Typical tags might be those disclosed in U.S. Pat. Nos. 4,221,025 and 4,299,870 and in copending application Ser. No. 08/004,592, all assigned to the same assignee hereof.

Figure 5:
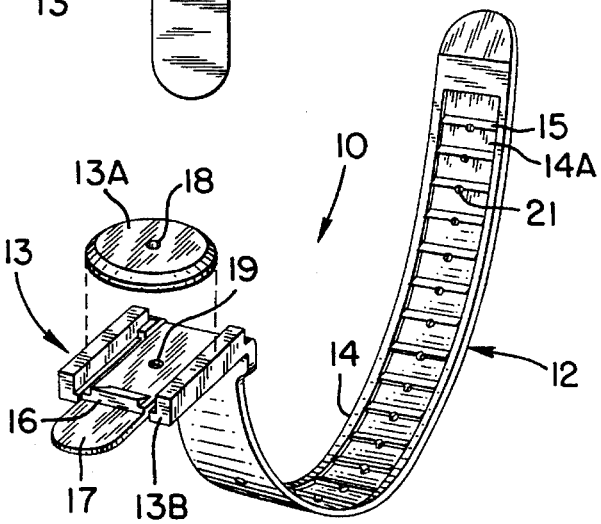
FIG. 5 shows an angled view of the attachment assembly of FIG. 1 in an open loop position.
Figure 6:
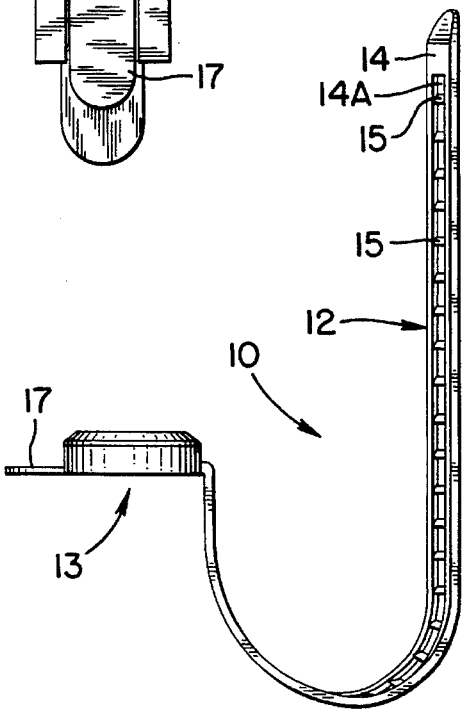
FIG. 6 shows a side view of the attachment assembly of FIG. 1 in an open loop position.

As best seen in FIGS. 1 and 5, the strap section 14 includes at the back end of each sub-section 14A an angled projection or abutment 15. Each abutment engages a further angled lip 16 (see, FIG. 5) on the lower wall 13B of the first end 13 when its corresponding sub-section 14A is passed into and through the channel formed by the first end. This engagement prevents withdrawal of the strap section from the channel of the first end, but allows continued movement of other sub-sections into and through such channel. In this way, different size loops can be formed.

The angled lip 16 is mounted to a flexible tongue 17 formed as part of the lower wall 13B so that the lip 16 can be moved out of engagement with an associated projection 15 of a strap sub-section 14A. By bending the flexible tongue, the strap section 14 can thus be withdrawn from the first end 13 to open the loop and thus release the attachment assembly from an article.

In accordance with the principles of the present invention, the strap section 14 and the first end 13 are also adapted to receive a locking means for locking the strap section and first end together when a subsection is in engagement with the first end. To this end, the upper and lower walls of the first end are provided with aligned apertures 18 and 19 and each of the sub-sections 14A is provided with an aperture 21 which slightly overlaps the projection 15 of the sub-section. The apertures 21 of the sub-sections are so positioned that when a projection 15 of a subsection 14A engages the lip 16 of the first end, an aperture 21 of one of the sub-sections is aligned with the apertures 18 and 19 of the first end. The aligned apertures can thus receive a locking means which engages the apertures and, thereby, locks the engaged sub-section 14A and first end 13 and thus the strap section 14 and first end 13 together.

In the present case, the pin 54 of the pin-like assembly 52 of the tag 11 extends through and engages the apertures. Clamping of the pin end in the tag body 51, thereby locks the engaged strap section 14A and first end 13 together and further locks the tag 11 to the strap 12. The tag 11 thus becomes attached to the article around which the attachment assembly is looped.

The strap 12 and first end 13 are preferably formed as a molded one-piece plastic part, with the initial part of the strap extending from the first end being at right angles, i.e., approximately 90°, to the first end. Also, the top wall 13A of the first end 13 is preferably flat and disc-shaped to better support the tag body.

Figure 7:
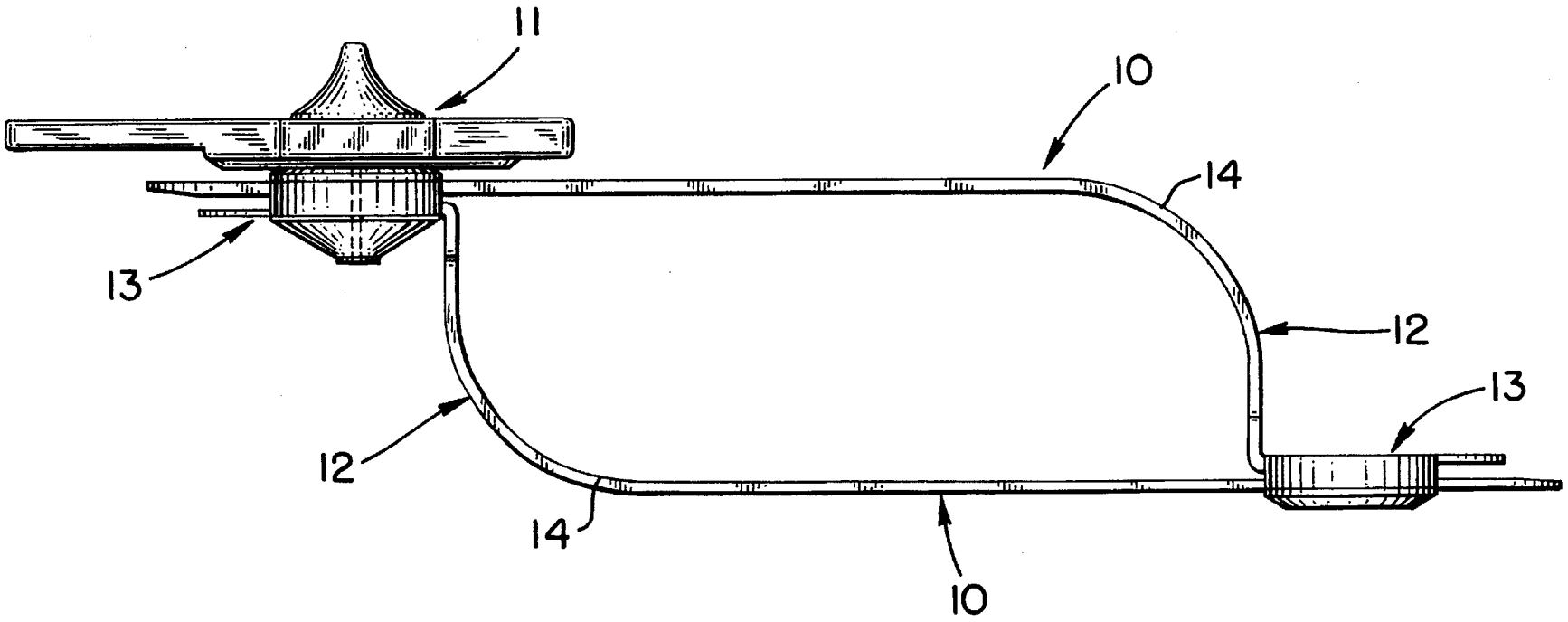
FIG. 7 shows a side view of two of the attachment assemblies of FIG. 1 connected together with a theft-deterrent tag attached to one assembly.

In FIG. 7, two attachment assemblies are shown as connected together to provide a larger loop. In this case, the strap section 14 of one assembly is engaged and locked to the first end 13 of the other assembly. Similarly, the strap section 14 of the latter assembly is engaged with and locked to the first end 13 of the first assembly in the case shown, the locking at one end of the combined assembly is via a tag 11. The other end may be similarly locked by a tag or by a pin-like assembly and clutch formed as individual parts and not as part of a tag. Also, any other locking mechanism locking the first end 13 and strap section 14 through the aligned apertures can be used in the assemblies 10.

In all cases it is understood that the above-described configuration is merely illustrative of the many possible specific embodiments which represent applications of the present invention. Numerous and varied other configurations, can be readily devised in accordance with the principles of the present invention without departing from the spirit and scope of the invention. For example, a detection device can be itself incorporated into the strap section 14 and/or first end 13 of the attachment assembly 10 of FIG. 1 and not be incorporated in a separate tag 11. In Such case, locking of the first end 13 and strap section 14 can be through a pin-like assembly and clamp as used in the tag 11.

What is claimed is:

1. An attachment assembly for a theft-deterrent tag for attachment to an article to be protected in an article surveillance system, the attachment assembly comprising:

a strap having a first end and a strap section extending from said first end, said first end being formed as channel member having spaced first and second walls, said strap section having subsections and being adapted to loop around so as to selectively bring said subsections of said strap section adjacent to and between said first and second walls of said first end, said strap section having a plurality of first engagement means spaced along the length of said strap section;

said first end having second engagement means adapted to couple with the first engagement means included in a subsection of said strap section brought adjacent to and between said first and second walls of said first end when said strap section is looped around, thereby to form a closed loop of a selective dimension; and said first end and said subsections of said strap section having further means for receiving locking means for locking said strap section and said first end together when a first engagement means of a subsection of said strap section is in engagement with the second engagement means of said first end, said further means for receiving said locking means including first and second through apertures in said first and second walls, respectively, of said first end and One or more apertures in said subsections of said strap section.

2. An attachment assembly in accordance with claim 1, further comprising:

a theft deterrent tag including a locking means for mounting said tag to said first end so that said locking means is received by said further means of said first end and said strap subsections, said locking means including a pin-like assembly having a pin which extends through said first and second through apertures in said first and second walls, respectively, of said first end and through an aperture in a subsection of said strap section.

3. An attachment assembly in accordance with claim 1, wherein:

said first end and said strap section are formed as a one-piece molded member.

4. An attachment assembly in accordance with claim 3, wherein:

said strap section extends from said first end initially at a right angle.

5. An attachment assembly in accordance with claim 1, wherein:

said strap section is thin and said first end is of a low profile.

6. An attachment assembly in accordance with claim 2, wherein:

said theft deterrent tag further includes a tag body disposed adjacent said first end and into which said pin extends, and means within said tag body for clamping said pin.

7. An attachment assembly in accordance with claim 1, wherein:

said second wall includes a flexible tongue portion supporting said second engagement means, said flexible tongue portion bringing said second engagement means into engagement with said first engagement means of a subsection of said strap section brought between said first and second walls to form said loop and said flexible tongue portion permitting release of said engagement.

8. An attachment assembly in accordance with claim 7, wherein:

said first and second through apertures are aligned.

9. An attachment assembly in accordance with claim 8 wherein:

said strap section includes a plurality of third through apertures spaced along the length of said strap section in predetermined relationship with respect to said plurality of first engagement means, a particular third through aperture aligning with said first and second through apertures when a first engagement means is in engagement with said second engagement means.

10. An attachment assembly in accordance with claim 9, wherein:

first engagement means comprises a plurality of projections extending from the plane of said strap section;

and said second engagement means includes a lip extending from the plane of said tongue portion.

11. An attachment assembly in accordance with claim 10, wherein:

the engagement of a projection and said lip is such that movement of said strap section through said channel member is permitted and movement of said strap section out of said channel member is inhibited.

12. An attachment assembly in accordance with claim 2, wherein:

said theft deterrent tag includes one of magnetic, rf and microwave means.

13. An attachment assembly for a theft-deterrent tag for attachment to an article to be protected in an article surveillance system, the attachment assembly comprising:

a first strap having a first end and a first strap section extending from said first end, a second strap having a second end and a second strap section extending from said second end, said second end being formed as a channel member having spaced first and second walls, said first strap section having first subsections and being adapted to selectively bring said first subsections of said first strap section adjacent to and between said first and second walls of said second end of said second strap, said first strap section having a plurality of first engagement means spaced along the length of said first strap section;

said second end of said second strap having second engagement means adapted to couple with the first engagement means included in a first subsection of said first strap section brought adjacent said second end of said second strap, said second end of said second strap and said first strap subsections of said first strap section having further means for receiving first locking means for locking said first strap section and said second end of said second strap together when a first engagement means of a first subsection of said first strap section is in engagement with the second engagement means of said second end of said second strap, said further means for receiving said locking means including first and second through apertures in said first and second walls, respectively, of said second end of said second strap section and one or more through apertures in said first subsections of said first strap section, said second strap section having second subsections and being adapted to selectively bring said second subsections of said second strap section adjacent to said first end of said first strap, said second strap section having a plurality of third engagement means spaced along the length of said second strap section, said first end of said first strap having fourth engagement means adapted to couple with the third engagement means included in a second subsection of said second strap section brought adjacent said first end of said first strap, and said first end of said first strap and said second subsections of said second strap section having additional means for receiving second locking means for locking said second strap section and said first end of said first strap together when a third engagement means of a second subsection of said second strap section is in engagement with the fourth engagement means of said first end of said first strap.

14. An attachment assembly in accordance with claim 13, further comprising:

a theft deterrent tag including a first locking means for mounting said tag to said second end of said second strap so that said first locking means is received by said further means of said second end of said second strap and said first subsections of said first strap section, said first locking means including a pin-like assembly having a pin which extends through said first and second through apertures in said first and second walls, respectively, of said second end of said second strap section and through an aperture in a first subsection of said first strap section.

15. An attachment assembly in accordance with claim 14, further comprising:

a second locking means received by said locking receiving additional means of said first end of said first strap and said second strap subsections of said second strap section.

16. An attachment assembly in accordance with claim 13 wherein:

said first end and said first strap section of said first strap are formed as a one-piece molded member, and said second end and said second strap section of said second strap are formed as a one-piece molded member.

17. An attachment assembly in accordance with claim 16, wherein:

said first strap section of said first strap extends from said first end of said first strap initially at a right angle, and said second strap section of said second strap extends from said second end of said second strap initially at a right angle.

18. An attachment assembly in accordance with claim 17, wherein:

said first and second straps have the same configuration.

19. An attachment assembly in accordance with claim 13, where in:

said additional means for receiving said second locking means includes one or more apertures in said first end of said first strap and said second subsections of said second strap section.

* * * * *

UNITED STATES PATENT AND TRADEMARK OFFICE

CERTIFICATE OF CORRECTION

PATENT NO. : 5,524,463

DATED : June 11, 1996

INVENTOR(S) : Howard M. Schenkel, et al.

It is certified that error appears in the above-indentified patent and that said Letters Patent is hereby corrected as shown below:

On the cover page, Item[54], change "EASY" to -- EAS--.

Col. 1, line 2, change "EASY" to -- EAS --.

Col. 2, line 28, change "views" to -- view --.

Col. 2, line 31, change "." to -- ; --.

Col. 3, line 56, change "assembly in" to -- assembly. In --.

Col. 4, line 5, change "Such" to -- such --.

Col. 4, line 13, after "as" insert -- a --.

Col. 6, line 61, change "where in" to -- wherein --.

Signed and Sealed this

Seventh Day of January, 1997

*Attest:*

BRUCE LEHMAN

*Attesting Officer*

*Commissioner of Patents and Trademarks*